United States Patent [19]

Nakaniwa et al.

[11] Patent Number: 4,817,572

[45] Date of Patent: Apr. 4, 1989

[54] ELECTRONICALLY CONTROLLED FUEL INJECTION DEVICE FOR AN INTERNAL COMBUSTION ENGINE

[75] Inventors: Shinpei Nakaniwa, Maebashi; Yukio Hoshino, Gunma; Naoki Tomisawa, Takasaki; Seiichi Otani, Maebashi; Tadashi Ariga; Shouji Furuhashi, both of Yokohama, all of Japan

[73] Assignees: Nissan Motor Co. Ltd.; Nippon Denshi Kiki Co., Ltd., both of Isezaki, Japan

[21] Appl. No.: 89,788

[22] Filed: Aug. 27, 1987

[30] Foreign Application Priority Data

Aug. 27, 1986 [JP] Japan ..... 61-199137

[51] Int. Cl.[4] ..... F02D 41/10

[52] U.S. Cl. ..... 123/492; 123/494

[58] Field of Search ..... 123/492, 493, 478, 494

[56] References Cited

U.S. PATENT DOCUMENTS

| | | | |
|---|---|---|---|
| 4,155,332 | 5/1979 | Yaegashi et al. | 123/494 X |
| 4,336,782 | 6/1982 | Endo et al. | 123/494 |
| 4,450,816 | 5/1984 | Takimoto et al. | 123/492 |
| 4,562,814 | 1/1986 | Abo et al. | 123/492 X |
| 4,712,529 | 12/1987 | Terasaka et al. | 123/492 |

FOREIGN PATENT DOCUMENTS 203828 11/1984 Japan .

*Primary Examiner*—Tony M. Argenbright

*Attorney, Agent, or Firm*—Foley & Lardner, Schwartz, Jeffery, Schwaab, Mack, Blumenthal & Evans

[57] ABSTRACT

An electronically controlled fuel injection device for an internal combustion engine during engine acceleration determines a basic amount of injected fuel based on the amount of intake airflow detected by an airflow meter and the engine velocity until the portion filled into the intake air manifold is detected, and then a basic amount of injected fuel based on the data of intake airflow which has been recorded excluding the portion filled into the intake air manifold.

5 Claims, 4 Drawing Sheets

ELECTRONICALLY CONTROLLED FUEL INJECTION DEVICE FOR AN INTERNAL COMBUSTION ENGINE

BACKGROUND OF THE INVENTION

1. Field of the Invention

The present invention relates to an electronically controlled fuel injection device for an internal combustion engine.

2. Description of the Related Art

An example of the conventional electronically controlled fuel injection device for an internal combustion engine is given in Japanese Patent Publication of Unexamined Application No. SHO-59-203828.

Specifically, the basic amount of fuel injection $T_p$ corresponding to the amount of intake air per one rotation of the engine is firstly calculated from the amount Q of intake air detected by an airflow meter and the engine velocity N detected by ignition signals etc., according to the equation:

$$T_p = K \times Q/N$$

where K is a constant.

Then, after calculation of the various revision coefficients COEF corresponding to the engine operating status determined from the cooling water temperature and the like, the revision coefficient $\alpha$ from the feedback of the air/fuel ratio, and the revised portion $T_s$ from the battery voltage, the amount of fuel injection $T_i$ is calculated according to the equation:

$$T_i = T_p \times \mathrm{COEF} \times \alpha + T_s.$$

Then an injection pulse signal of the pulse width corresponding to the calculated amount $T_i$ of fuel injection is output to the fuel injection valve, so that a prescribed amount of fuel is injected into the engine.

Incidentally, especially in the case of the Multi-Point Injection System (MPI System), when the throttle valve opens during acceleration, the air is first drawn into the air intake manifold as a result of the negative pressure therein, and the intake manifold is full of air before the air is drawn into the cylinder. The air which fills the intake manifold also is detected by the airflow meter used for measuring the amount of the intake airflow, so that the airflow meter indicates an amount which is greater than the actual amount Q of intake air (the air which is actually drawn into the cylinder). This condition is illustrated in FIG. 4.

Accordingly, the amount of fuel injected is erroneously determined such that it corresponds to an air amount which is greater than the actual amount of air to be required. Especially in the case of the MPI System, the amount of fuel corresponding to this determined amount of fuel injection is immediately fed into the cylinder, so that the problem of air/fuel ratio overshooting occurs.

In this way, the erroneous detection of the amount of intake airflow during acceleration results in the air/fuel ratio overshoots, which cause problems such as breathing, flooding of the spark plugs, and worsening of the exhaust gas properties (increase in CO and HC).

In order to solve these problems, some conventional electronically-controlled fuel injection devices set the amount of fuel injected on the basis of the detected value of the area $\alpha$ of throttle valve opening and the engine velocity N when the engine is accelerating.

Specifically, data is previously recorded for the amount Q of intake air corresponding to a plurality of operating regions, in which the area $\alpha$ of throttle valve opening and the engine velocity N are used as parameters, and, from that data, a value for the amount Q of intake airflow for a specific operating region is retrieved based on the detected values for the area $\alpha$ of throttle valve opening and the engine velocity N. Thus, the fuel injection amount during engine accelerating is set based on the retrieved amount Q of intake airflow and the detected value N of the engine velocity.

Accordingly, a value close to the actual amount Q of intake airflow is retrieved in the recorded data even when, at the time the engine is accelerating, the portion of air filling the intake air manifold is detected by the airflow meter, because the data for the amount Q of intake airflow is recorded for the steady state operation of the engine. Accordingly, with a setting for the amount of injected fuel based on the amount Q of intake airflow which is retrieved as previously mentioned, overshooting of the air/fuel ratio does not occur.

However, in the initial period of accelerating, that is, in the region of low opening area (before the air intake manifold is filled as in FIG. 4), there is generally a wide variation in the detection accuracy of the sensor which detects the area of opening of the throttle valve, so that the amount Q of intake airflow for a wrong operating region outside that particular operating region may be obtained through retrieving. This makes control of the air/fuel ratio very difficult.

SUMMARY OF THE INVENTION

An object of the present invention is to provide with due consideration to the drawbacks of such conventional devices, an electronically controlled fuel injection device for an internal combustion engine wherein the amount of fuel injection corresponding to the actual amount of intake airflow is correctly set when the engine is accelerating, so that good air/fuel ratio control is obtained.

A further object of the present invention is to provide an electronically controlled fuel injection device for an internal combustion engine having a means for detecting the amount of intake airflow to detect the portion filled into the intake air manifold during acceleration of the engine, wherein when that detected value is greater than a retrieved amount of intake airflow which is previously determined on the basis of the detected values for the area of opening of the throttle valve and the engine velocity, the setting of the basic amount of injected fuel based on the detected amount of intake airflow up to that time is changed to the setting of the basic amount of injected fuel based on the retrieved amount of intake airflow.

A still further object of the present invention is to provide an electronically controlled fuel injection device for an internal combustion engine wherein the basic amount of injected fuel is set based on the amount of intake airflow detected by an airflow meter until the portion filled into the intake air manifold is detected, and then the amount of injected fuel is set, based on the data of intake airflow which has been recorded without including the portion filled into the intake air manifold.

A still further object of the present invention is to provide an improved electronically controlled fuel injection device for an internal combustion engine wherein, during acceleration of the engine, the amount of air drawn into the intake air manifold has no effect on the amount of injected fuel.

BRIEF DESCRIPTION OF THE DRAWINGS

These end other objects, features, and advantages of the present invention will become more apparent from the following description of the preferred embodiments taken in conjunction with the accompanying drawings, in which.

DETAILED DESCRIPTION OF THE PREFERRED EMBODIMENTS

Figure 1:
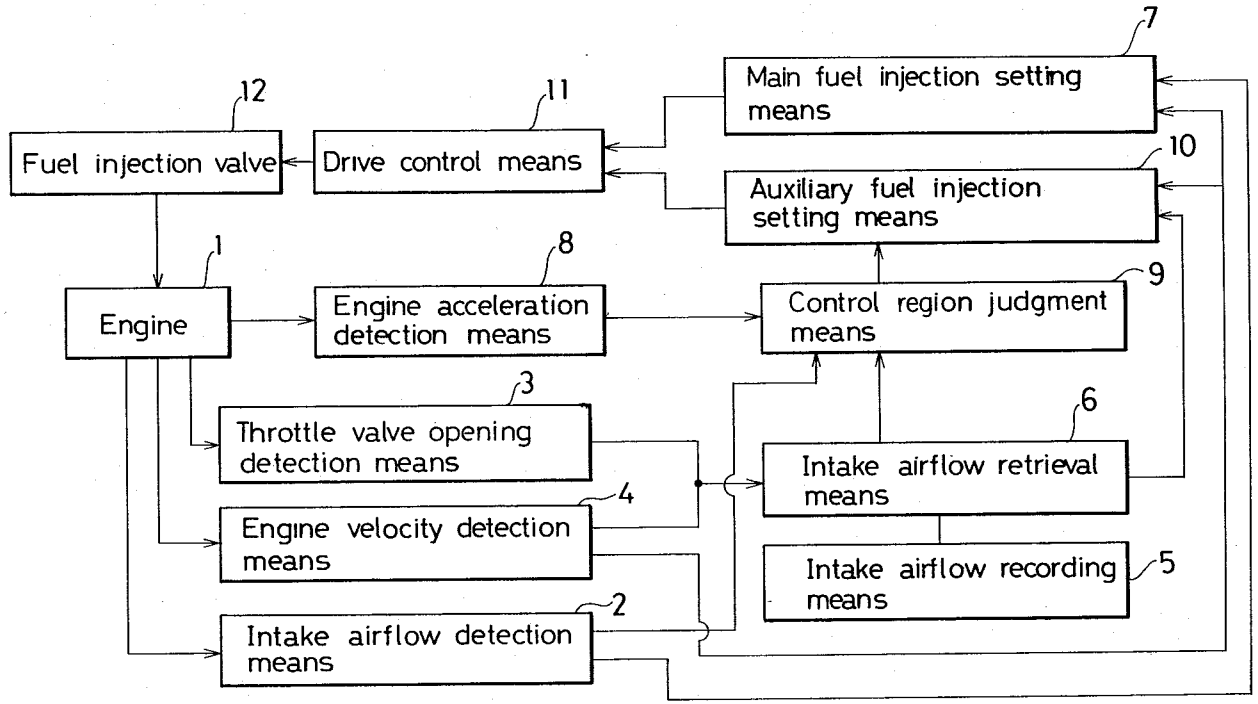
FIG. 1 is a block diagram of the present invention.

Now referring to FIG. 1, the electronically controlled fuel injection device for an internal combustion engine 1 comprises an intake airflow detection means 2 which detects the amount of intake airflow for an internal combustion engine; a throttle valve opening detection means 3 which is positioned in the air intake channel and detects the area of opening of a throttle valve; and internal combustion engine velocity detection means 4 which detects the the engine velocity; an intake airflow memory means 5 which records the amount of intake airflow corresponding to each operating region with the area of throttle valve opening and the engine velocity as parameters; an intake airflow retrieval means 6 which retrieves the amount of intake airflow corresponding to an appropriate operating region from the intake airflow memory means based on the detected values for the area of opening of the throttle valve and the engine velocity obtained from the detection means; a main fuel injection setting means 7 which sets the amount of fuel injected, based on the detected amount of the intake airflow and the engine velocity; an engine acceleration detection means 8 which detects the acceleration status of the engine; a control region judgment means 9 by which it is determined in the engine accelerating condition as detected by the engine acceleration detection means that in the operating region for engine acceleration, the basic amount of fuel injection is to be controlled based on the retrieved amount of intake airflow when the detected amount of intake airflow is judged to be larger than the retrieved amount of intake airflow in comparison; an auxiliary fuel injection setting means 10 which sets the amount of fuel injected, with priority over the main fuel injection setting means, based on the value of the engine velocity detected by the engine velocity detection means and on the amount of intake airflow retrieved by means of the intake airflow retrieval means, only when it is judged that this is the operating region for engine acceleration in which the basic amount of fuel injection is to be controlled based on the retrieved amount of intake airflow; and a drive control means 11 which controls the driving of a fuel injection valve 12 corresponding to the amount of injected fuel set by the main fuel injection setting means for by the auxiliary fuel injection setting means.

Figure 2:
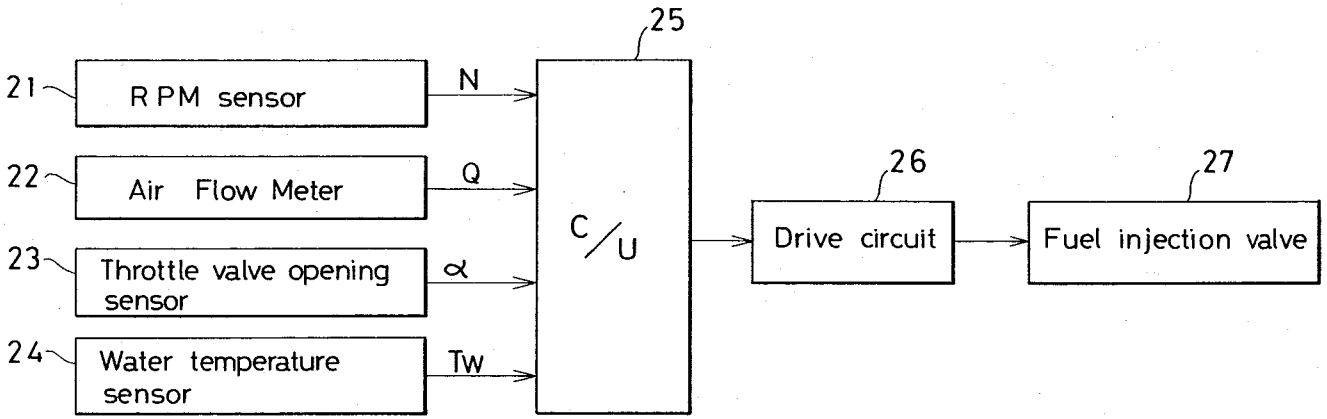
FIG. 2 is a system block diagram showing an embodiment of the electronically controlled fuel injection device for an internal combustion engine of the present invention.

In FIG. 2, the hardware configuration for an embodiment of the electronically controlled fuel injection device for an internal combustion engine of the present invention is shown.

In this drawing, an RPM sensor 21 is used as a means for detecting the engine velocity. The output from the RPM sensor 21 is an engine velocity signal N. An air flowmeter 22 is used as a means for detecting the amount of intake airflow. The output from the air flowmeter 22 is an intake airflow signal Q. A throttle valve opening sensor 23 is used as a means for detecting the area of opening of the throttle valve. The output of the throttle valve opening sensor 23 is a throttle valve opening signal $\alpha$. In addition, a cooling water temperature signal $T_w$ indicating the temperature of the engine cooling water is output from a water temperature sensor 24. These signals are input to a control unit 25, which is built into a microcomputer which comprises an I/O device, a memory device, and a CPU device. The control unit 25 outputs an injection pulse signal (for which the setting is later described) to a drive circuit 26 of a fuel injection valve 27 on the basis of the signals mentioned above.

Specifically, in this embodiment of the present invention, the control unit 25 and the throttle valve opening sensor 23 make up an engine acceleration detection means 8, and the control unit 25 and the drive circuit 26 make up a drive control means 11. In addition, the control unit 25 includes, through the software, the intake airflow recording means 2, the intake airflow retrieval means 6, the main fuel injection setting means 7 , the auxiliary fuel injection setting means 10, and the control region judgment means 9.

Figure 3:
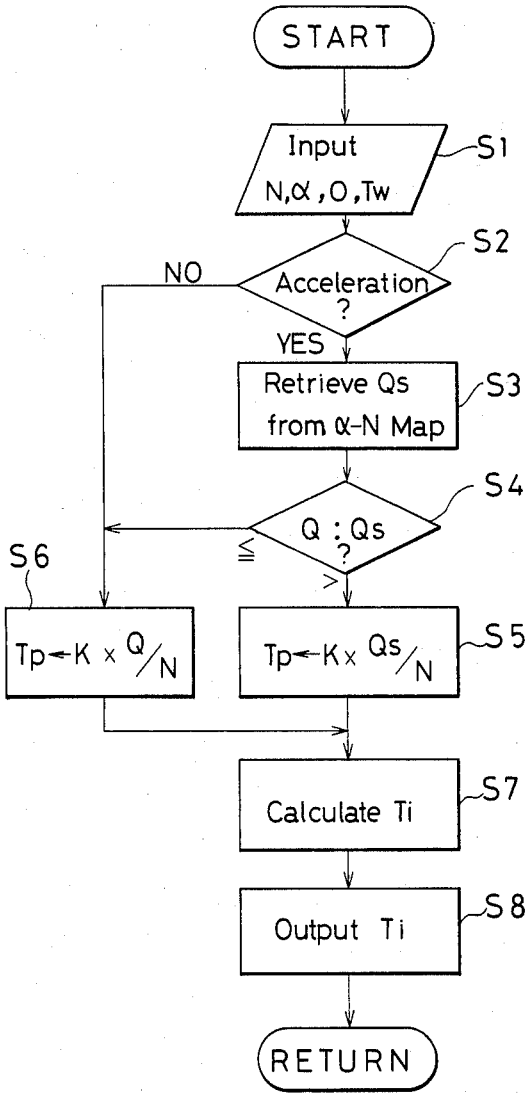
FIG. 3 is a flowchart showing the control of the fuel injection in the embodiment of the electronically controlled fuel injection device for an internal combustion engine of FIG. 2.
Figure 4:
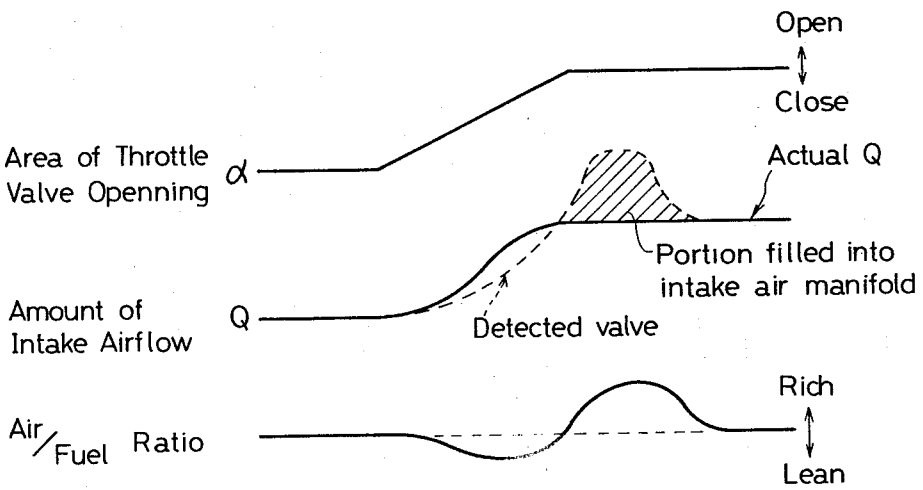
PRIOR ART FIG. 4
FIG. 4 is a timing chart illustrating problems in conventional control devices.

Next, the operation of the present invention will be described, based on the flowchart of FIG. 3.

At a Step $S_1$, the engine velocity N, the amount Q of intake airflow, the area $\alpha$ of throttle valve opening, and the cooling water temperature $T_w$ are input, having been detected by means of the respective sensors.

At a Step $S_2$, a judgment is made as to whether the engine is accelerating or not, by means of the rate of change $\Delta\alpha$ in the opening area obtained from the area $\alpha$ of throttle valve opening and the previously input area $\alpha_s$ of throttle valve opening. Specifically, when the rate of change $\Delta\alpha$ exceeds a prescribed value toward its open position, or when the area of opening is changing for a predetermined time toward its open position, the engine is taken to be in accelerating status, and the program advances to the Step $S_3$, or in the case where there is no acceleration, advances to a Step $S_6$.

At the Step $S_3$, the recorded amount $Q_s$ of intake airflow is retrieved, based on the area $\alpha$ of throttle valve opening and the engine velocity N which had been input in the Step $S_1$. Here, the recorded amount $Q_s$ of intake airflow was obtained from a previous test or the like, and is stored corresponding to a plurality of operating regions with the area $\alpha$ of throttle opening and the engine velocity N as parameters. It will be noted that the recorded amount $Q_s$, which does not include the portion filled into the intake air manifold, is very close to and can represent the actual amount of air taken into the cylinder when the amount of intake air is erroneously detected.

At the Step $S_4$, the amount Q of intake airflow, which is the detected value of the airflow meter 2 input in the Step $S_1$, and the intake airflow amount $Q_s$, which is the retrieved value in the Step $S_3$, are compared. In the case of $Q > Q_s$ the program advances to a Step $S_5$, and in the case of $Q<Q_s$, or $Q=Q_s$, the program advances to a Step $S_6$ in the same way as in the case where it is judged that the engine is not accelerating at the Step 2.

Specifically, only in the case where the engine is accelerating and the detected amount of the intake airflow exceeds the retrieved value $Q_s$, the program advances to the Step $S_5$. At the Step $S_5$, based on the retrieved amount $Q_s$ of intake airflow in the Step $S_3$, the basic amount $T_p$ of fuel injection ($=K\times Q_s/N$; where K is a constant) is calculated.

This is explained as follows. When the engine is accelerating, as previously stated, the airflow meter 2 detects the portion which fills the intake air manifold in addition to the actual amount of air that is taken into the cylinder. Thus the amount Q of intake airflow output as a detected amount is increased by the portion which fills the intake air manifold. Consequently, the existence of the portion which fills the intake air manifold is known indirectly, from the fact of $Q>Q_s$, and the basic amount $T_p$ of fuel injection is calculated based on the retrieved amount $Q_s$ of the intake airflow in the erroneously detected region of the airflow meter 2. As previously stated, the portion which fills the intake air manifold is not included in the retrieved value. The amount of fuel injection corresponding to the actual amount of air taken into the cylinder is substantially correctly set in this way.

On the other hand, in the case where the engine is not accelerating or in the case where the engine is accelerating under the condition of $Q<Q_s$, or $Q=Q_s$ (in the case where the airflow meter 2 does not detect the portion of the intake air filling the intake manifold), the basic amount $T_p$ of fuel injection ($=K\times Q/N$; where K is a constant) is calculated in the Step $S_6$ based on the amount Q of intake airflow detected by the airflow meter 2.

Accordingly, in the operating region for engine acceleration where the error of the value detected by the throttle valve opening sensor 3 is erroneously large, that is, the area of throttle valve opening is still small, the basic amaount of fuel injection is set based on the detected amount Q of the intake airflow. Otherwise, in the operating region, the amount $Q_s$ of intake airflow would be retrieved based on the erroneously detected area $\alpha$ of the throttle opening, and the base fuel injection amount $T_p$ would be set erroneously.

After the basic amount $T_p$ of fuel injection is calculated in the Step $S_5$ or the Step $S_6$, a revised calculation is made for the basic amount $T_p$ of fuel injection in the Step $S_7$ and a final amount $T_i$ of fuel injection is obtained.

Specifically, revision coefficients are retrieved based on the respective operating status set or recorded in a recording device on the basis of an engine cooling water temperature $T_w$ detected by the water temperature sensor 4 and various operating conditions such as the engine acceleration status. By means of revision coefficients COEF, for which the revision coefficients mentioned above are calculated, the basic amount $T_p$ of fuel injection is revised to set the amount $T_i$ of fuel injection.

After the amount $T_i$ of fuel injection is set in the Step $S_7$, in the Step $S_8$ an injection pulse signal of a pulse width corresponding to the amount $T_i$ of fuel injection is output to the drive circuit 6 of the fuel injection valve 7 and fuel injection is carried out.

As shown in the above explanation, with the electronically controlled fuel injection device for an internal combustion engine of the present invention, the erroneous detection by an intake airflow detection means (airflow meter) is known by comparing this detected value for the amount of intake airflow and the retrieved amount intake airflow of based on the area of throttle valve opening and the engine velocity. In the erroneous detection region, by setting the basic amount of fuel injection based on the retrieved amount of the intake airflow, the basic amount of fuel injection is set to substantially correspond to the actual amount of air which is taken into the cylinder, with the result that the operating characteristics when the engine is accelerating can be improved.

What is claimed is:

1. An electronically controlled fuel injection device for an internal combustion engine comprising:

a fuel injection means;

a main fuel injection setting means which sets an amount of fuel to be injected, based on a detected amount of intake airflow for said engine and a detected engine velocity;

an auxiliary fuel injection setting means which sets an amount of fuel to be injected, based on a detected engine velocity and an retrieved amount of intake airflow;

a control region judgement means for selecting in a specific operating region for engine acceleration one of said main and auxiliary fuel injection setting means for operation of said fuel injection means;

an intake airflow retrieval means which determines said retrieved amount of intake airflow corresponding to said operating region from the data of intake airflow previously made based on the area of opening of a throttle valve and said engine velocity;

said control region judgement means adapted to compare said detected amount of intake airflow with said retrieved amount of intake airflow during said operating region for engine acceleration, to select said main fuel injection setting means for operation when said detected amount of intake airflow is less than or equal to said retrieved amount of intake airflow, and to select said auxiliary fuel injection setting means when said detected amount of intake airflow is larger than said retrieved amount of intake airflow.

2. An electronically controlled fuel injection device for an internal combustion engine comprising:

a throttle valve opening detection means which is positioned in an air intake channel and detects the area of opening of a throttle valve;

an engine velocity detection means which detects an engine velocity;

an intake airflow detection means which detects an amount of intake airflow for the internal cumbustion engine;

an intake airflow recording means which records the amount of intake airflow corresponding to each operating region with the area of throttle valve opening and the engine velocity as parameters;

an intake airflow retrieval means which retrieves an amount of intake airflow corresponding to an operating region for engine acceleration from the intake airflow recording means based on detected values for the area of opening of the throttle valve and the engine velocity;

a main fuel injection setting means which sets an amount of fuel injected, based on the detected amount of the intake airflow detected by the intake airflow detection means and the engine velocity;

an engine acceleration detection means which detects an acceleration status of the engine;

a control region judgment means by which a judgment is made that in the operating region, the amount of fuel injection is to be determined based on the retrieved amount of intake airflow when the detected amount of intake airflow is larger than the retrieved amount of the intake airflow while the amount of fuel injection is to be determined based on the detected amount of intake airflow when the detected amount of intake airflow is less than or equal to the retrieved amount of intake airflow;

an auxiliary fuel injection setting means which sets an amount of fuel injected, with priority over the main fuel injection setting means, based on the engine velocity and the amount of intake airflow retrieved by the intake airflow retrieval means, only when it is judged that in the operating region, the amount of fuel injection is to be determined based on the retrieved amount of the intake airflow; and a drive control means which controls the driving of the fuel injection valve for an amount of fuel to be injected corresponding to the amount of fuel injection set by the main fuel injection setting means or by the auxiliary fuel injection setting means.

3. A method for electronically controlling fuel injection during engine acceleration in an internal combustion engine comprising the steps of:

(a) detecting an amount of intake airflow of the engine and an engine velocity for controlling an amount of fuel injection;

(b) retrieving a previously recorded amount of intake airflow on the basis of an area of opening in a throttle valve and the engine velocity;

(c) comparing the retrieved amount of intake airflow with the detected amount of intake airflow;

(d) controlling the amount of fuel injection based on the retrieved amount of intake airflow when the detected amount of intake airflow is greater than the retrieved amount of intake airflow;

(e) controlling the amount of fuel injection based on the detected amount of intake airflow when the detected amount of intake airflow is less than or equal to the retrieved amount of intake airflow; and (f) repeating the steps (a) to (e) until the engine acceleration is ended.

4. An electronically controlled fuel injection device for determining an amount of fuel injection for an internal combustion engine comprising:

an engine velocity detection means which detects an engine velocity;

an intake airflow detection means which detects an amount of intake airflow for said internal combustion engine;

a throttle valve opening detection means which detects an area of opening of a throttle valve for air intaking;

a fuel injection means for supplying said engine with an amount of fuel to be injected;

a drive circuit means for operating said fuel injection means, and a control unit for storing a set of data of said amount of intake airflow in a relationship with said area of opening of said throttle valve and said engine velocity and for outputting an injection impulse signal to said drive circuit means for said amount of fuel to be injected;

said control unit adapted to determine said amount of fuel to be injected on the basis of said amount of fuel injection, said amount of fuel injection determined on the basis of said detected engine velocity and said detected amount of intake airflow, and said control unit adapted to replace said detected amount of intake airflow with an amount of intake airflow which is retrieved in said set of data based on said engine velocity and said area of opening of said throttle valve when said detected amount of intake airflow is larger than said retrieved amount of intake airflow.

5. An electronically controlled fuel injection device for an internal combustion engine comprising:

a fuel injection means;

a main fuel injection setting means which sets an amount of fuel to be injected, based on a detected amount of intake airflow for said engine and a detected engine velocity;

an auxiliary fuel injection setting means which sets an amount of fuel to be injected, based on a detected engine velocity and a retrieved amount of intake airflow;

a control region judgement means for selecting in a specific operating region one of said main and auxiliary fuel injection setting means for operation of said fuel injection means;

an intake airflow retrieval means which determines said retrieved amount of intake airflow corresponding to said operating region from the data of intake airflow previously made based on the area of opening of a throttle valve and said engine velocity;

said control region judgement means adapted to compare said detected amount of intake airflow with said retrieved amount of intake airflow during said operating region, to select said main fuel injection setting means for operation when said detected amount of intake airflow is less than or equal to said retrieved amount of intake airflow, and to select said auxiliary fuel injection setting means when said detected amount of intake airflow is larger than said retrieved amount of intake airflow.

* * * * *